US009206668B2

(12) United States Patent
Wood

(10) Patent No.: US 9,206,668 B2
(45) Date of Patent: Dec. 8, 2015

(54) VALVE

(71) Applicant: National Oilwell Varco UK Limited, Manchester (GB)

(72) Inventor: Carl Richard Wood, Alford (GB)

(73) Assignee: National Oilwell Varco UK Limited, Audenshaw, Manchester (GB)

( * ) Notice: Subject to any disclaimer, the term of this patent is extended or adjusted under 35 U.S.C. 154(b) by 487 days.

(21) Appl. No.: 13/633,290

(22) Filed: Oct. 2, 2012

(65) Prior Publication Data

US 2013/0081823 A1 Apr. 4, 2013

(30) Foreign Application Priority Data

Oct. 3, 2011 (GB) ..... 1116966.1

(51) Int. Cl.
*E21B 34/06* (2006.01)
*E21B 29/04* (2006.01)
*E21B 29/08* (2006.01)

(52) U.S. Cl.
CPC ..... *E21B 34/06* (2013.01); *E21B 29/04* (2013.01); *E21B 29/08* (2013.01)

(58) Field of Classification Search
CPC ..... E21B 29/04; E21B 29/08; E21B 34/02; E21B 34/06; E21B 34/002
USPC ..... 251/159, 174
See application file for complete search history.

(56) References Cited

U.S. PATENT DOCUMENTS 1,587,030 A * 6/1926 Palmer ..... 166/90.1
2,661,926 A * 12/1953 Resek ..... 137/625.47
2,883,146 A * 4/1959 Knox ..... 251/159
3,171,429 A * 3/1965 Sturmer et al. ..... 137/315.19
3,245,653 A 4/1966 Lavigueur
3,765,439 A 10/1973 Wise
3,870,101 A * 3/1975 Helmus ..... 166/363
3,870,104 A * 3/1975 Mott ..... E21B 34/106 166/208
3,926,252 A * 12/1975 Ribeyre ..... E21B 29/04 114/221 A
3,934,606 A * 1/1976 Matthews ..... 137/454.6
4,009,753 A * 3/1977 McGill ..... E21B 29/04 166/298

(Continued)

FOREIGN PATENT DOCUMENTS

DE 3824919 A1 2/1989
GB 1416085 A 12/1975
SU 857608 A1 8/1981

OTHER PUBLICATIONS

Dictionary definition of "chord", accessed Feb. 13, 2015 via thefreedictionary.com.*

*Primary Examiner* — Blake Michener
(74) *Attorney, Agent, or Firm* — Winstead PC

(57) ABSTRACT

A valve has a moveable member movable between open and closed configurations and a cutting device arranged to shear against an anvil member when moving between the open and closed configurations and a sealing member providing a seat for seating of the moveable member when the moveable member is in the closed configuration. The anvil member and the sealing member are moveable relative to one another when the moveable member is moving from the open to the closed configuration. During opening and closing the sealing member is displaced away from the cutting device as the cutting device engages the anvil member. The sealing member is pushed away from the moveable member and the anvil to a maximum separation from the movable member at the point on the stroke when the cutting surface of the moveable member is moving past the anvil member.

26 Claims, 11 Drawing Sheets

(56) References Cited

U.S. PATENT DOCUMENTS 4,160,478 A * 7/1979 Calhoun ..... E21B 29/04 166/319
4,293,038 A 10/1981 Evans
4,641,682 A * 2/1987 Harris ..... 137/329.04
4,651,828 A * 3/1987 Doremus ..... 166/319
4,676,480 A 6/1987 Garceau et al.
4,681,133 A * 7/1987 Weston ..... 137/315.18
5,050,839 A * 9/1991 Dickson ..... E21B 29/04 166/324
5,167,283 A * 12/1992 Smith et al. ..... 166/373
5,253,843 A * 10/1993 Garceau ..... 251/159
5,284,209 A * 2/1994 Godfrey ..... 166/380
5,338,001 A 8/1994 Godfrey et al.
5,551,665 A * 9/1996 Noack et al. ..... 251/58
5,771,974 A * 6/1998 Stewart ..... E21B 34/045 166/322
6,152,229 A * 11/2000 Jennings ..... 166/321
6,668,933 B2 * 12/2003 Kent ..... E21B 29/04 166/321
6,681,793 B2 * 1/2004 Mike ..... 137/15.22
7,510,002 B2 * 3/2009 Brown et al. ..... 166/84.3
2002/0046842 A1 * 4/2002 Kent ..... E21B 29/04 166/368
2007/0278438 A1 * 12/2007 Scott ..... F16K 5/205 251/172
2010/0051847 A1 * 3/2010 Mailand ..... E21B 29/04 251/288
2013/0025711 A1 * 1/2013 Russell ..... E21B 21/10 137/512

* cited by examiner

VALVE

FIELD OF THE INVENTION

This invention relates to a valve, typically a ball valve, and especially to a ball valve used in an oil or gas well, typically in an intervention or well control string.

BACKGROUND TO THE INVENTION

In downhole wellbores the flow paths through the main bores of the well and other flow conduits are typically controlled by valves. The valves typically close and open against a seat which provides a sealing face to engage with a movable member in the valve and prevent fluid flow. Typically the seat is faced with a resilient material that conforms to the sealing face of the valve to create the seal.

Problems arise when the seat of the valve is damaged by the movement of the moveable member between its open and closed configurations. Typically, in a ball valve, the valve moves between its open and closed configurations by rotation of the ball, to rotate a bore in the ball in and out of alignment with the bore of the conduit in which the ball valve is located. As the bore of the ball rotates out of alignment with the bore of the tubular, the edge of the bore can sometimes tear or otherwise damage the seat against which the ball seals, possibly tearing the resilient material on the face of that seat.

This is particularly problematic when the ball valve needs to cut a wire or other elongate member that is passing through the bore as it moves between the open and closed configurations, because the inner edge of the bore through the ball typically becomes damaged by shearing of the wire, and the damaged edge then rakes across the more delicate seating surface on the seal, typically causing tears and other damage to the softer material used on that component. When the ball valve has closed and the bore of the valve is out of alignment with the bore of the tubular, the sealing surface of the ball frequently does not seal adequately against the damaged surface of the seat, and leaks then arise when the stroke has been completed.

SUMMARY OF THE INVENTION

In accordance with the invention there is provided a valve for use in an oil or gas well, the valve comprising a moveable member configured to move between open and closed configurations of the valve to allow and resist flow of fluid through the valve in respective open and closed configurations, the moveable member having a cutting surface adapted to shear against an anvil member when the moveable member is moving between the open and closed configurations; the valve having a sealing member providing a seat for seating of the moveable member when the moveable member is in the closed configuration; wherein the valve has a sealing member displacement mechanism configured to vary the spacing between the sealing member and the movable member when the moveable member is moving between the open and the closed configurations.

The invention also provides a method of operating an oil or gas well valve, the valve comprising a moveable member configured to move between open and closed configurations of the valve to allow flow of fluid through the valve when the valve is in the open configuration, and to resist flow of fluid through the valve when the valve is in the closed configuration, the valve having a sealing member providing a seat for seating of the movable member when the movable member is in the closed configuration; the movable member having a cutting surface arranged to shear against an anvil member when the movable member is moving between the open and closed configurations; wherein the method includes varying the spacing between the sealing member and the movable member during the stroke of the moveable member between the open configuration and the closed configuration.

Typically the sealing member displacement mechanism moves the sealing member away from the moveable member during the stroke of the moveable member between the open and closed configurations. Typically the sealing member is displaced away from the cutting surface (typically the inner surface of the bore) of the movable member when the cutting surface engages the anvil member. Typically the sealing member is moveable and the anvil member is located in a fixed position. However, in certain embodiments, the anvil member can be moveable relative to a fixed sealing member. Typically one of the sealing member and the anvil is moveable in an axial direction, parallel to the axis of the throughbore of the valve.

Typically the valve is a ball valve and the movement of the valve between the open and closed configurations is a rotational movement to rotate a bore through the ball valve between an aligned and an unaligned configuration with respect to the bore of the conduit in which the valve is located.

Typically the sealing member displacement mechanism comprises a cam device having a non-circular profile that pushes the seal away from the moveable member. Typically the cam member is arranged to push the sealing member to a maximum separation from the movable member at the point on the stroke of the moveable member when the cutting surface of the moveable member is moving past the anvil member.

Typically the cam member is located on a rotating part of the valve, typically on the ball of the ball valve. Typically the ball is spherical, and the cam member is non-circular. Typically the cam member is located on a part of the moveable member such that the cam member engages with the sealing member but does not engage with the anvil member.

Typically the anvil and sealing members are concentrically arranged, typically with the anvil member located radially inwards of the sealing member, and the sealing member surrounding the anvil member.

Typically more than one cam member can be provided. The cam member can optionally be formed separately and attached subsequently to the moveable member, or can comprise an integral part of the moveable member in the form of a non-circular projection from the outer surface of the moveable member.

Optionally, a pair of cam members can be provided on the ball. Typically the pair of cam members can be parallel to one another, and can typically have the same non-circular arrangement, so that movement of the moveable member moves each of the cam members against the seal member at the same time. The cam members are typically arranged as chords on the ball, on the outer surface of the ball and spaced radially between the centre of the ball and its outer surface. Typically the chordal cam members can be disposed at any location between the centre of the ball and the outer circumference, and do not need to be located halfway between these points. Optionally the cam members can be formed as tangential formations on the ball, or can approach a tangential position.

The cam members are typically provided with an outer bearing surface that slides against the sealing member, to push the sealing member axially away from the moveable member during the stroke of the moveable member between the open and closed configurations. The bearing surface is typically smooth and typically has a relatively low co-efficient of friction, and so typically slides against the seat of the sealing member without substantially deforming the seat.

Typically the sealing member is biased against the moveable member by a resilient means, typically a spring such as a coil spring, although gas springs, and other resilient devices can be employed to press the sealing member axially against the moveable member. Typically the cam member moves the sealing member in such a way as to energise the resilient devices that bias the sealing member against the movable member. Typically the cam members overcome the force of the springs etc. to move the sealing members radially back axially with respect to the bore of the tubular in which the valve is located, moving the sealing faces on the seat of the sealing member away from the hard faced cutting surface as it passes across the anvil member.

Typically the sealing member is moved out of contact with the moveable member by the cam when the cutting surface engages the anvil member, and moves back into contact with the moveable member when the cutting surface has passed the sealing member and the sealing surface of the moveable member (e.g. the outer surface of the ball) is aligned with the sealing member.

The resilient devices biasing the sealing member against the moveable member then typically push the sealing member against the sealing face of the moveable member to seal against passage of fluid through the valve when the cutting face has passed the anvil member and seal member.

Typically the anvil member has a close fit with the cutting surface of the moveable member and provides a shearing function to shear any wires or other longitudinal members passing through the bore of the valve. Typically the opposing faces of the anvil member and the cutting surface and the movable member can be faced with hard materials such as tungsten carbide, diamond, etc.

Spacing the cam members radially outside the anvil member but with a radial spacing that is less than the outer diameter of the sealing member means that the rotation of the ball to rotate the cam members can engage the cam members with the sealing member but can avoid reacting the cam members against the anvil member. Therefore, the seal member can be pushed axially away from the ball without engaging the anvil members and reducing the force available from the cam members as a result of the rotation of the ball.

Typically the cam members engage the sealing sleeve at a position radially outside a resilient seal on the sealing sleeve. Typically the cam members do not engage the resilient seal during the stroke of the movable member between the open and closed configurations.

Typically the sealing member remains axially spaced from the movable member until the cutting surface of the movable member has moved past the resilient seal on the sealing member, at which point the sealing member can be moved back into contact with the movable member to compress the resilient seal against the movable member once more.

The various aspects of the present invention can be practiced alone or in combination with one or more of the other aspects, as will be appreciated by those skilled in the relevant arts. The various aspects of the invention can optionally be provided in combination with one or more of the optional features of the other aspects of the invention. Also, optional features described in relation to one embodiment can typically be combined alone or together with other features in different embodiments of the invention.

Various embodiments and aspects of the invention will now be described in detail with reference to the accompanying figures. Still other aspects, features, and advantages of the present invention are readily apparent from the entire description thereof, including the figures, which illustrates a number of exemplary embodiments and aspects and implementations. The invention is also capable of other and different embodiments and aspects, and its several details can be modified in various respects, all without departing from the spirit and scope of the present invention. Accordingly, the drawings and descriptions are to be regarded as illustrative in nature, and not as restrictive. Furthermore, the terminology and phraseology used herein is solely used for descriptive purposes and should not be construed as limiting in scope. Language such as "including," "comprising," "having," "containing," or "involving," and variations thereof, is intended to be broad and encompass the subject matter listed thereafter, equivalents, and additional subject matter not recited, and is not intended to exclude other additives, components, integers or steps. Likewise, the term "comprising" is considered synonymous with the terms "including" or "containing" for applicable legal purposes.

Any discussion of documents, acts, materials, devices, articles and the like is included in the specification solely for the purpose of providing a context for the present invention. It is not suggested or represented that any or all of these matters formed part of the prior art base or were common general knowledge in the field relevant to the present invention.

In this disclosure, whenever a composition, an element or a group of elements is preceded with the transitional phrase "comprising", it is understood that we also contemplate the same composition, element or group of elements with transitional phrases "consisting essentially of", "consisting", "selected from the group of consisting of", "including", or is preceding the recitation of the composition, element or group of elements and vice versa.

All numerical values in this disclosure are understood as being modified by "about". All singular forms of elements, or any other components described herein are understood to include plural forms thereof and vice versa.

BRIEF DESCRIPTION OF THE DRAWINGS

An embodiment of the invention will now be described by way of example and with reference to the accompanying drawings in which.

DETAILED DESCRIPTION OF AN ILLUSTRATIVE EMBODIMENT OF THE INVENTION

Figure 1:
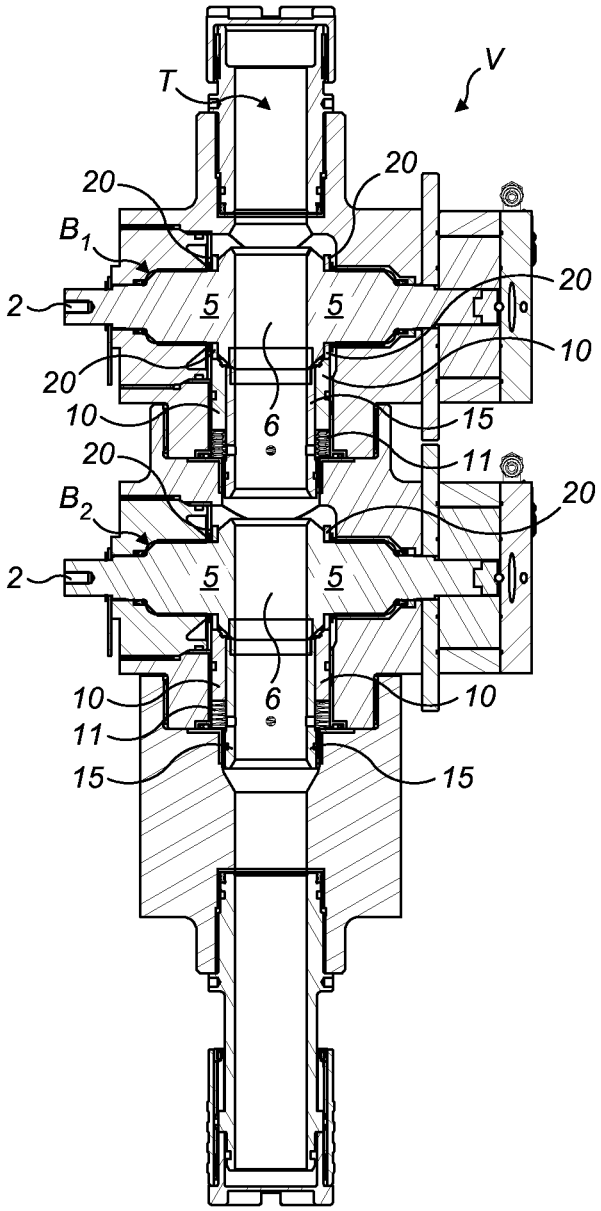
FIGS. 1, 2 and 3 are plan, end and side views of a valve in an open configuration.
Figure 2:
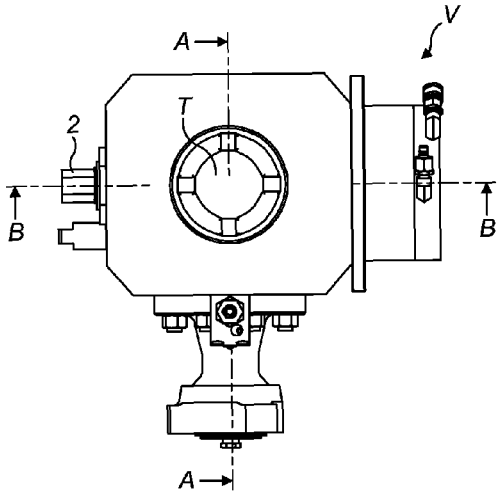
Figure 3:
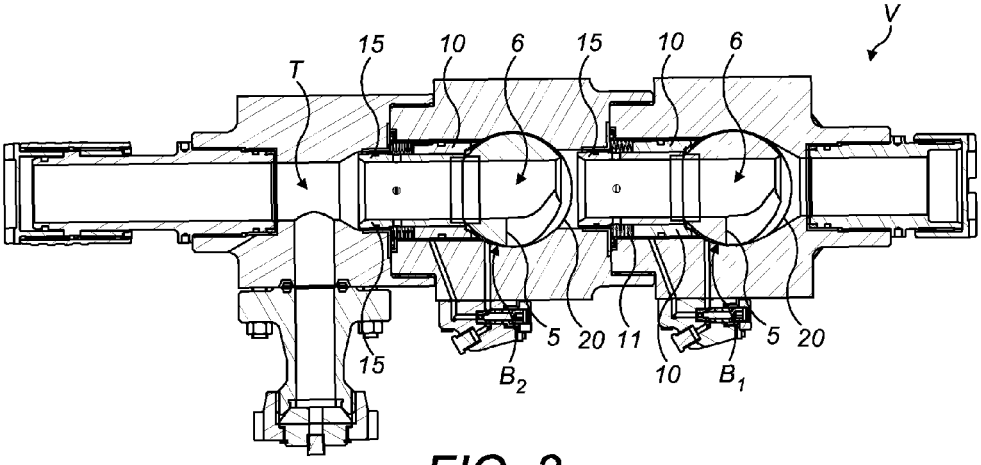
Figure 4:
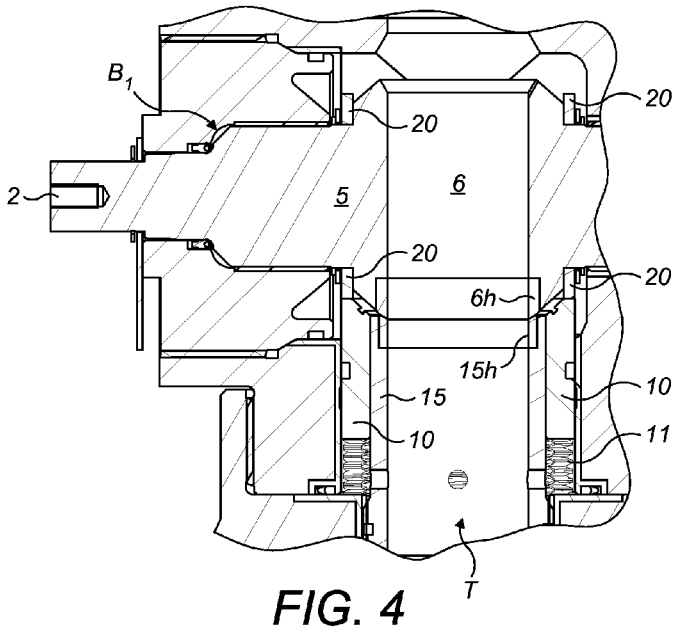
FIGS. 4 and 5 are enlarged views of FIGS. 1 and 3 respectively.
Figure 5:
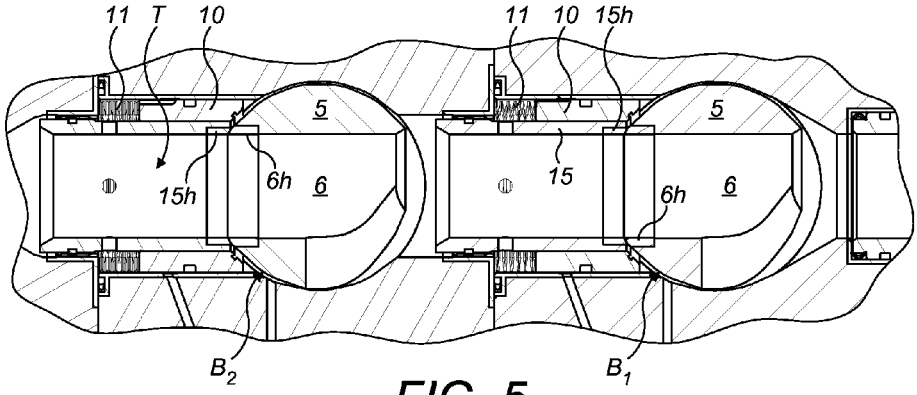
Figure 6:
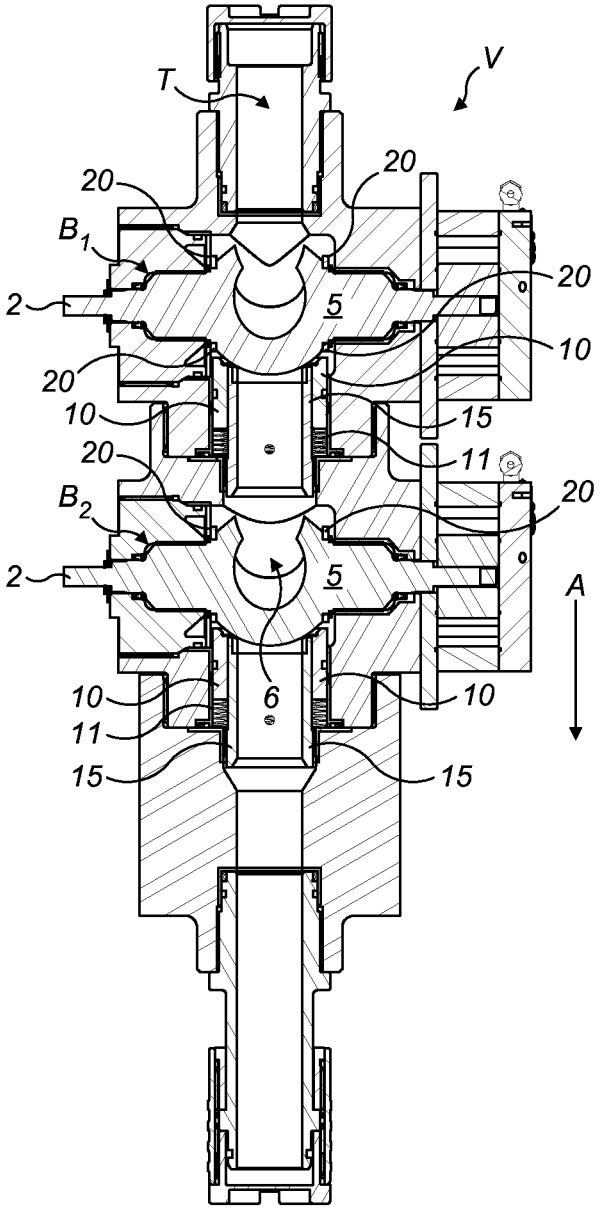
FIGS. 6 and 7 are plan and side views of the FIG. 1 valve in a transitional configuration during movement of the valve between open and closed configurations.
Figure 7:
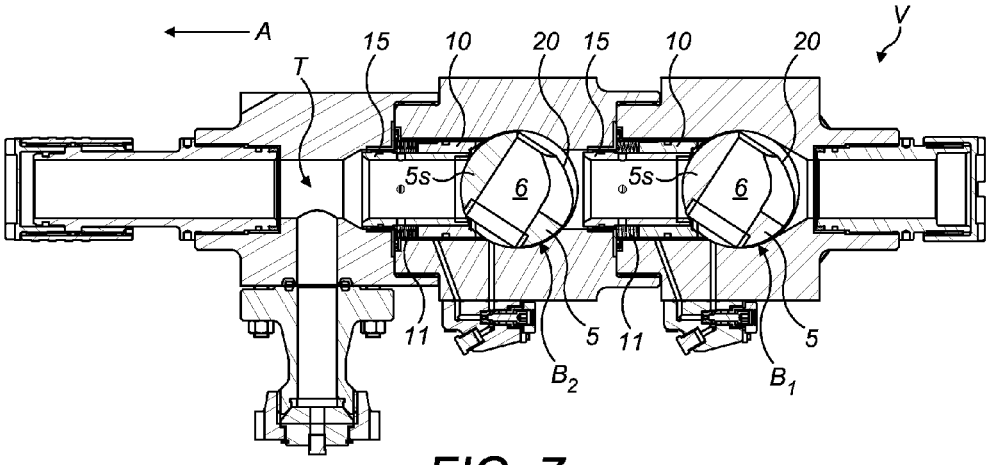
Figure 8:
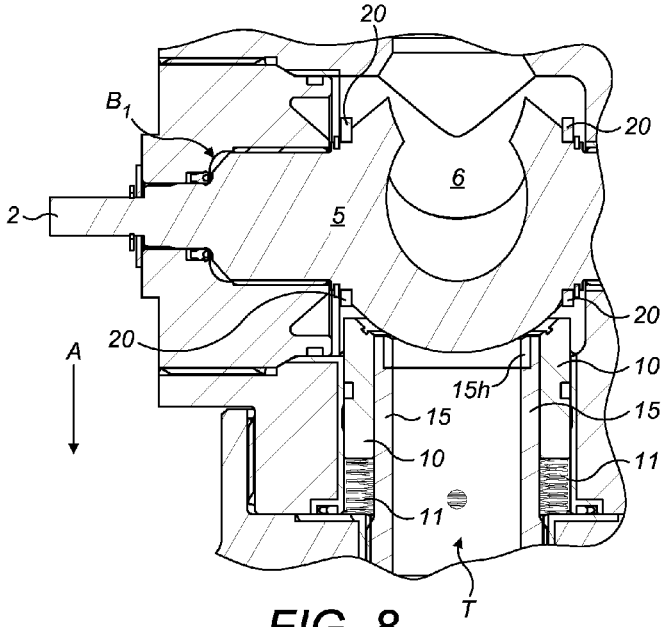
FIGS. 8 and 9 are enlarged views of FIGS. 6 and 7 respectively.
Figure 9:
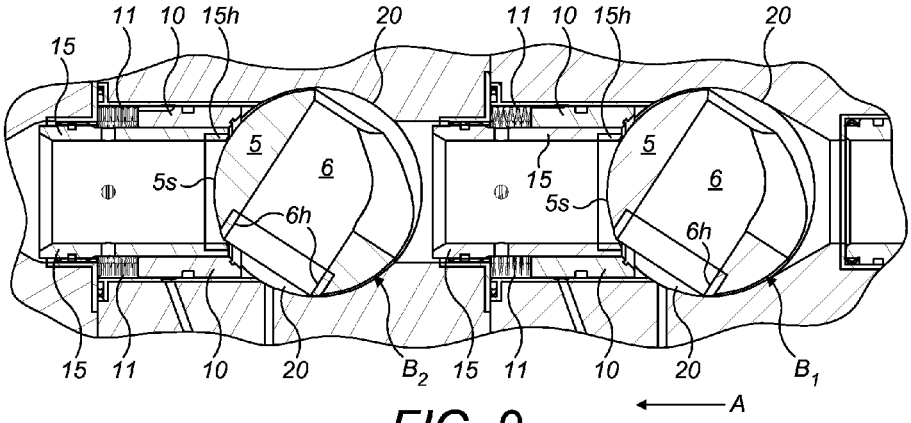
Figure 10:
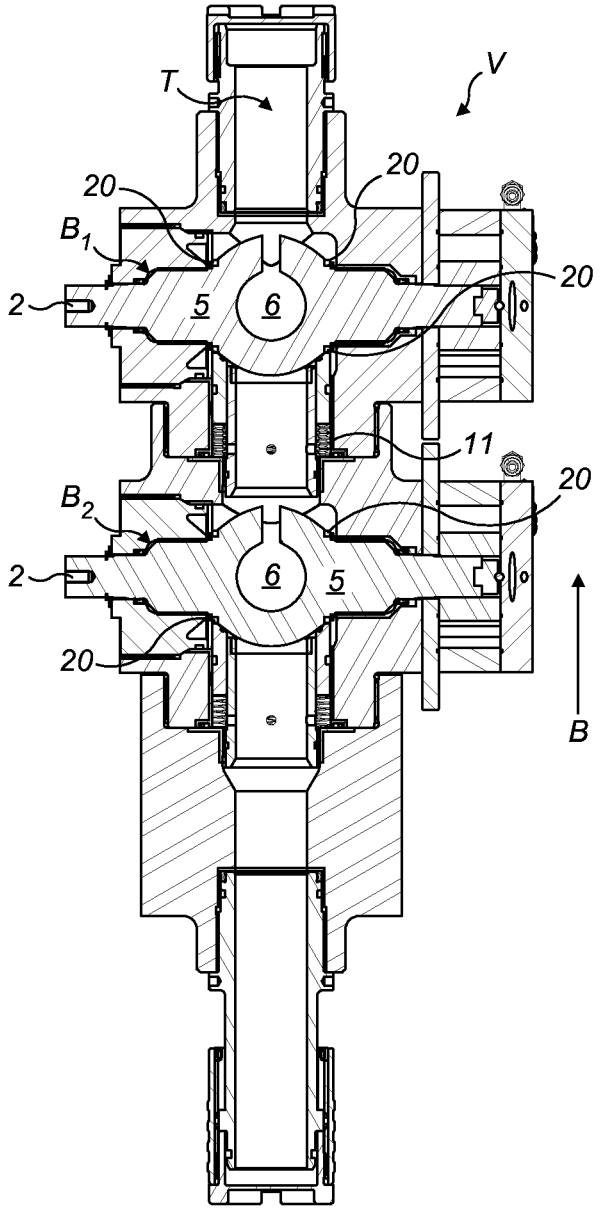
FIGS. 10 and 11 are plan and side views of the FIG. 1 valve in a closed configuration.
Figure 11:
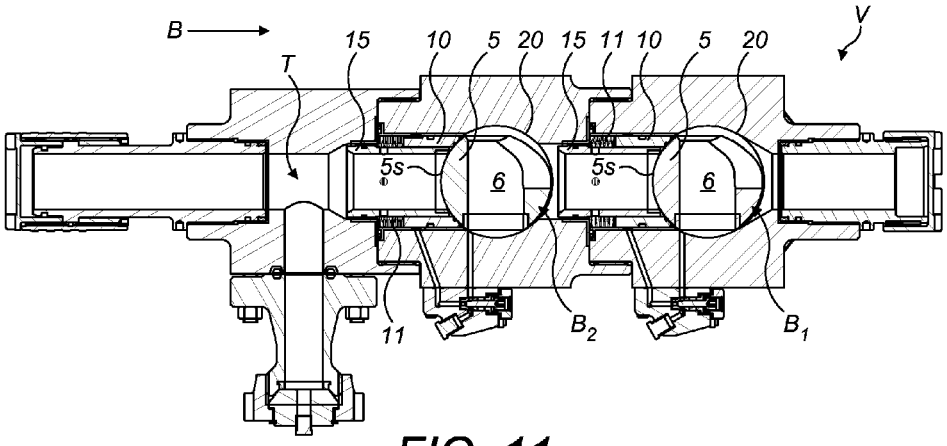
Figure 12:
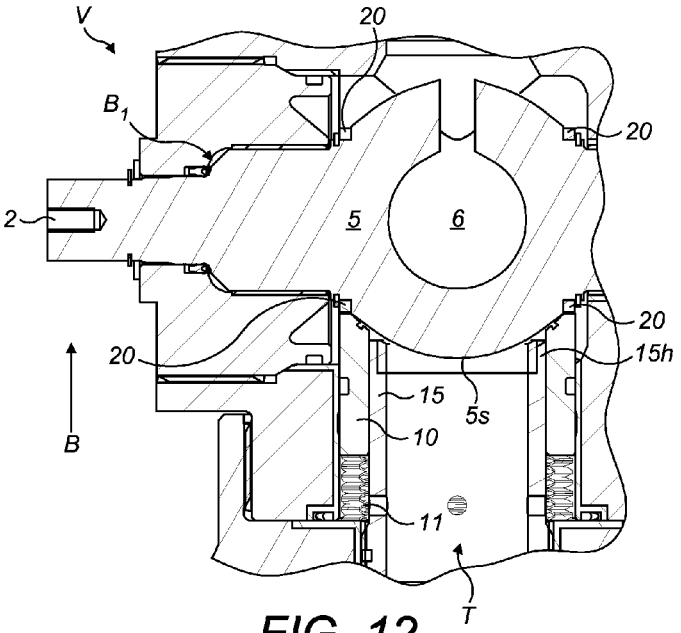
FIGS. 12 and 13 are enlarged views of FIGS. 10 and 11 respectively.
Figure 13:
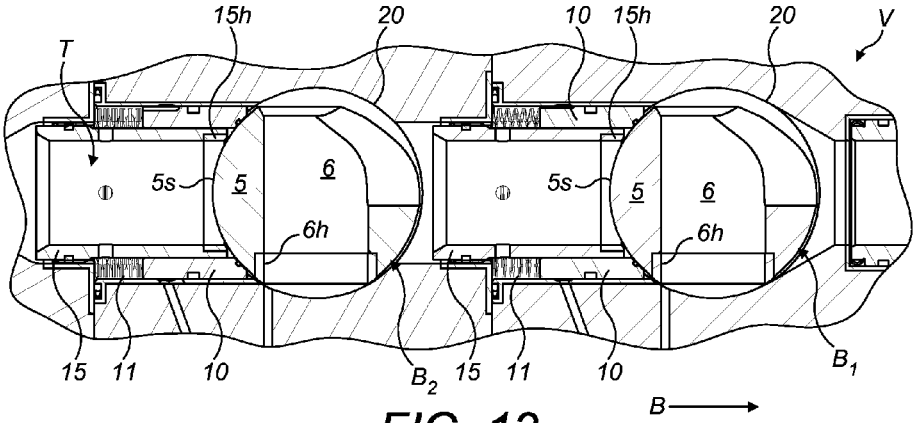
Figure 14:
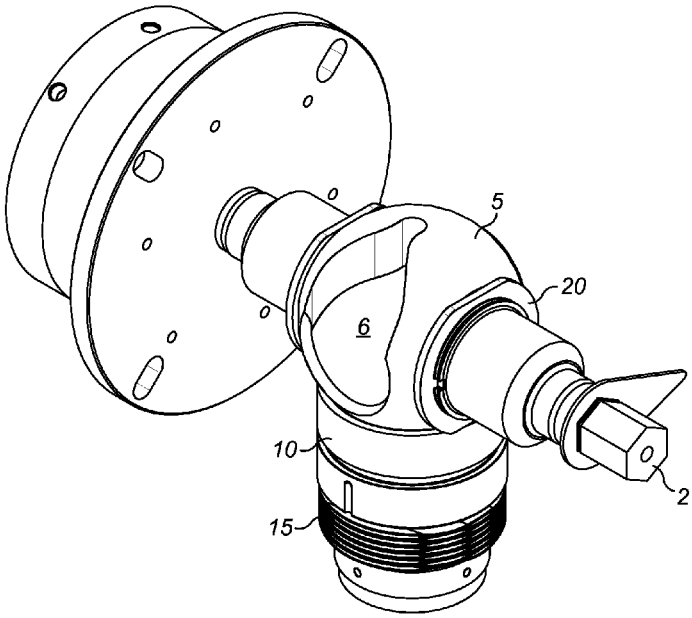
FIGS. 14 and 15 are perspective views of the ball of the valve of FIG. 1 in different rotational positions of the ball.
Figure 15:
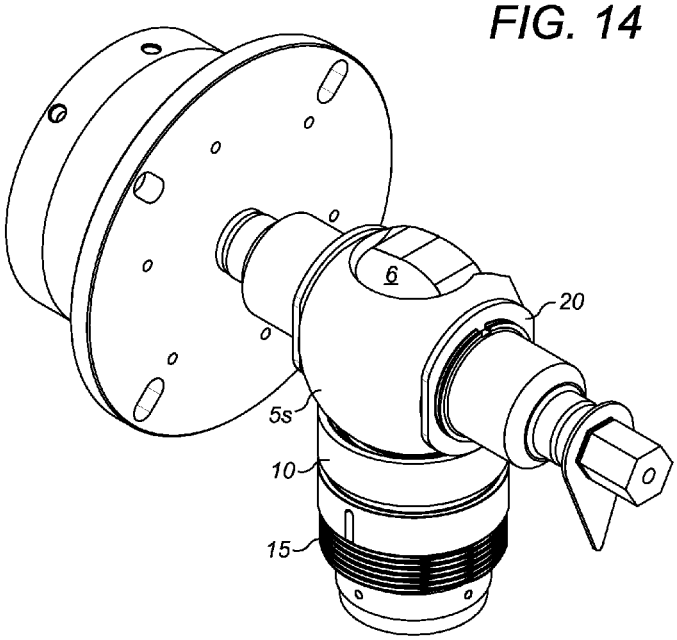

Referring now to the drawings, and referring particularly to FIGS. 1 to 5, in an open configuration a valve V has a through bore T that is open and closed by first and second moveable members in the form of ball members B1 and B2 arranged in series in the valve V, and arranged to provide backup in the event of failure of one of the ball members. Each ball member B comprises a generally spherical ball 5 mounted on a transverse axle 2. The axles 2 are parallel to one another in the valve V and extend perpendicular to the axis of the through bore T, allowing rotation of the balls 5 around the axles 2. Each ball 5 has a through bore 6, which can be brought in an out of register with the through bore T. Rotation of the balls 5 around the axles 2 rotates the through bore 6 in and out of alignment with the through bore of the valve T, thereby moving the valve V from an open configuration, in which the through bore of 6 of each ball 5 is aligned with the through bore T of the valve, to a closed position, in which the through bore 6 of each ball 5 is non-aligned with the through bore T of the valve (and is typically perpendicular thereto).

Each ball 5 seats against a sealing member in the form of a sealing sleeve 10. The sealing sleeve 10 typically has a seat in the form of a bevelled inner surface closest to the ball 5 where it engages with the ball 5. The bevelled inner surface of the end is configured to match the sealing face of the ball 5*s* to create a seal denying fluid passage past the ball 5. Typically the bevelled inner face carries a resilient seal, such as an o-ring seal retained in a seal groove. The seal is compressed between the bevelled face of the sleeve 10 and the sealing face of the ball when the valve is closed. The sealing sleeve 10 is axially movable in a direction parallel to the axis of the through bore T and is biased against the sealing face 5*s* of the ball 5 by a spring 11. This compresses the resilient seal on the inner bevelled surface of the sleeve 10 between the sleeve 10 and the ball 5, to resist passage of fluid. The end face of the sleeve 10 outside the bevelled inner face typically has a flat face, which is typically perpendicular to the axis of the throughbore. Typically the flat end face acts as a bearing surface, and can be provided with a friction reducing coating. The end bearing surface is typically located outside the resilient seal, spaced radially away from the seal.

The sealing sleeve 10 has a central bore which is coaxial with the through bore T. Within the bore of the sealing sleeve 10 is provided an anvil member in the form of an anvil sleeve 15, which typically also has a through bore that is coaxial with the bore T of the valve, and is typically configured to allow the passage of fluids through the valve V when the balls 5 are in the open orientation. The inner surface of the neck of the anvil sleeve 15 nearest to the ball 5 has a cutting surface in the form of a hard faced ring 15*h* formed of a hardened material such as ceramic material, diamond or tungsten carbide etc. Typically the ring 15*h* is provided on the inner surface of the anvil sleeve 15. Typically the anvil sleeve 15 is fixed within the through bore T so that it is not axially moveable and is adapted to resist axial forces tending to move it. It can be connected within the bore T by screw threads, or by collets or dogs etc. Typically the anvil sleeve 15 remains fixed in position when the sealing sleeve 10 moves axially with respect to the through bore T.

The outer surface of the ball 5 typically has a sealing member displacement mechanism that typically takes the form of at least one cam member 20. The cam member typically extends circumferentially with respect to the ball 5, at a radial spacing from the centre of the ball that is in alignment with a portion of the flat bearing end surface of the sealing sleeve 10, but is radially spaced outward from the anvil sleeve 15, and out of alignment with it. Typically two cam members 20 are provided at chordal or tangential locations on the outer surface of the ball 5 at a spacing that engages the flat end surface of the sealing sleeve 10 at each side of the sealing sleeve 10, but so that the lateral spacing between each of the cam members 20 is larger than the outer diameter of the anvil sleeve 15, which passes between the cam members 20. The cam members 20 are typically arranged parallel to the through bore 6 of the bore through each ball 5, so that as the ball 5 rotates around the axle 2, the cam members 20 are rotated at the same time. The cam members 20 on each side of the ball 5 are typically symmetrical in their cam profile so that rotation of the ball presents a uniform side profile as the cam profile changes with the rotation. The cam members typically have non-circular side profiles as best seen in FIGS. 3, 5, 7, 9, 11, 13, 14 and 15. Typically the cam members engage the bearing surface on the flat end face of the sealing sleeve 10 outside the bevelled inner face with the resilient seal, and hence the cam surfaces typically do not contact the more delicate seat with the resilient seal inside the flat end face.

Rotation of the balls 5 by the axles 2 rotates each cam member 20 so that the cam profile of the part of the cam member 20 that engages the flat end bearing surface of the sealing sleeve 10 changes with the rotational position of the ball 5. When the valve V is in the open configuration shown in FIGS. 1 to 5 and 16, the side profile of the cam devices 20 is very close to the nominal outer circumference of the ball 5, and has little or (typically) no effect on the axial movement of the sealing sleeve 10, which remains pressed hard against the sealing surface 5*s* of the ball 5, compressing the resilient seal and sealing the throughbore. However, as the ball 5 starts to rotate from the open to the closed position, and the alignment of the cutting surface 6*h* of the ball 5 starts to change relative to the sealing sleeve 10, the profile of the cam members 20 that is pressed against the flat end bearing surface of the sealing sleeve 10 also starts to change, and the cam profile of the cam members 20 starts to increase beyond the nominal outer diameter of the ball, thereby pushing the sealing sleeve 10 axially away from the ball in the direction of arrow A against the force of the spring 11 as the rotation progresses and the change in alignment continues. The axial displacement of the cam profile reaches a peak at the point shown in FIG. 9. At this stage, a hard facing ring 6*h* on the inner surface of the arcuate through bore 6 through the ball 5 is about to shear against the hard facing 15*h* on the anvil sleeve 15, in order to cut any wire, cable or other elongate member that remains within the through bore T of the valve V at the point when the arcuate ring 6*h* shears past the hard facing 15*h* on the anvil sleeve 15. The hard facing ring 6*h* is axially spaced away from the delicate resilient seal on the bevelled inner surface of the sealing sleeve 10 because of the action of the cam members 20, and so it cannot rake across the seat or damage the resilient seal as it rotates in relation to the anvil sleeve 15.

At this stage, the cam members 20 are approaching or optionally have reached their maximum displacement away from the nominal outer surface of the ball, and have pushed the sealing sleeve 10 axially back in the direction of arrow A against the force of the springs 11, thereby compressing the springs, and pushing the seat with the delicate sealing face at the bevelled inner surface of the end of the sealing sleeve 10 axially away from the moving cutting surface 6*h*. The increased axial displacement of the cam members continues while the ball 5 rotates past the cutting point shown in FIG. 9 until the hard faces 6*h* and 15*h* have passed one another and the hard face 6*h* on the inner surface of the bore 6 through the ball 5 has rotated past the outer diameter of the sealing sleeve 10 and can no longer rake the seat at the bevelled end sealing surface of the sealing sleeve 10. Thus the cams 20 keep the sealing sleeve 10 spaced away from the ball 5 for as long as the moving cutting surface 6*h* is aligned with the resilient seal on the bevelled end surface of the sleeve 10. Therefore, while the cutting surface 6*h* is inside the diameter of the sealing sleeve 10, the sealing sleeve 10 and cutting surface 6*h* are spaced apart, and the cutting surface cannot rake the resilient seal. Typically the cams 20 keep the sealing sleeve 10 spaced axially away from the movable member at least until the cutting surface on the ball 5 has rotated past the sealing sleeve 10, but it is especially useful for the separation to be maintained until the whole of the rotating cutting surface 6*h* has moved past the outer diameter of the sleeve 10, so that the end surfaces of the sleeve 10 are kept axially away from the rotating cutting surface 6*h* on the ball. After the point of maximum displacement, the cam profile on the cam members 20 starts to diminish to reduce the axial displacement of the cam relative to the nominal outer diameter of the ball 5, which allows the spring 11 to push the sealing sleeve 10 back into engagement with the sealing surface 5*s* of the ball as the cams 20 reduce their displacement. At this point, since the ball has rotated past the point at which the cutting surface is aligned with the sealing sleeve 10, the delicate sealing surface on the sleeve can never contact the cutting surface of the ball 5, so even if the moving cutting surface 6*h* eventually becomes deformed or burred through the high forces required for the cutting process, the burrs or surface deformations on the cutting surface do not interfere with the delicate resilient seal on the sleeve 10 when the valve is opening and closing. The valve V is then in the configuration shown in FIGS. 11 to 16, in which the spring 11 is forcing the sealing sleeve 10 hard against the sealing surface 5*s* of the ball 5 in the direction of the arrow B, as the hard facing cutting edge 6*h* has been moved out of alignment with the delicate sealing surface of the sealing sleeve 10.

Stroking of the valve V back to its open configuration automatically moves the cam members 20 in reverse urging the sealing sleeve 10 axially away from the ball 5, so that the delicate resilient sealing surface of the sealing sleeve 10 is not raked by the hard facing 6*h* on the ball 5 during the rotation.

The cam members 20 can be fully circumferential, extending around the entire circumference, or can extend around only a part of the circumference if desired. One cam member can suffice, but a more even force is applied by the more symmetrical arrangement of two cam members, and a more even movement of the sealing sleeve 10 is thereby achieved.

Figure 16:
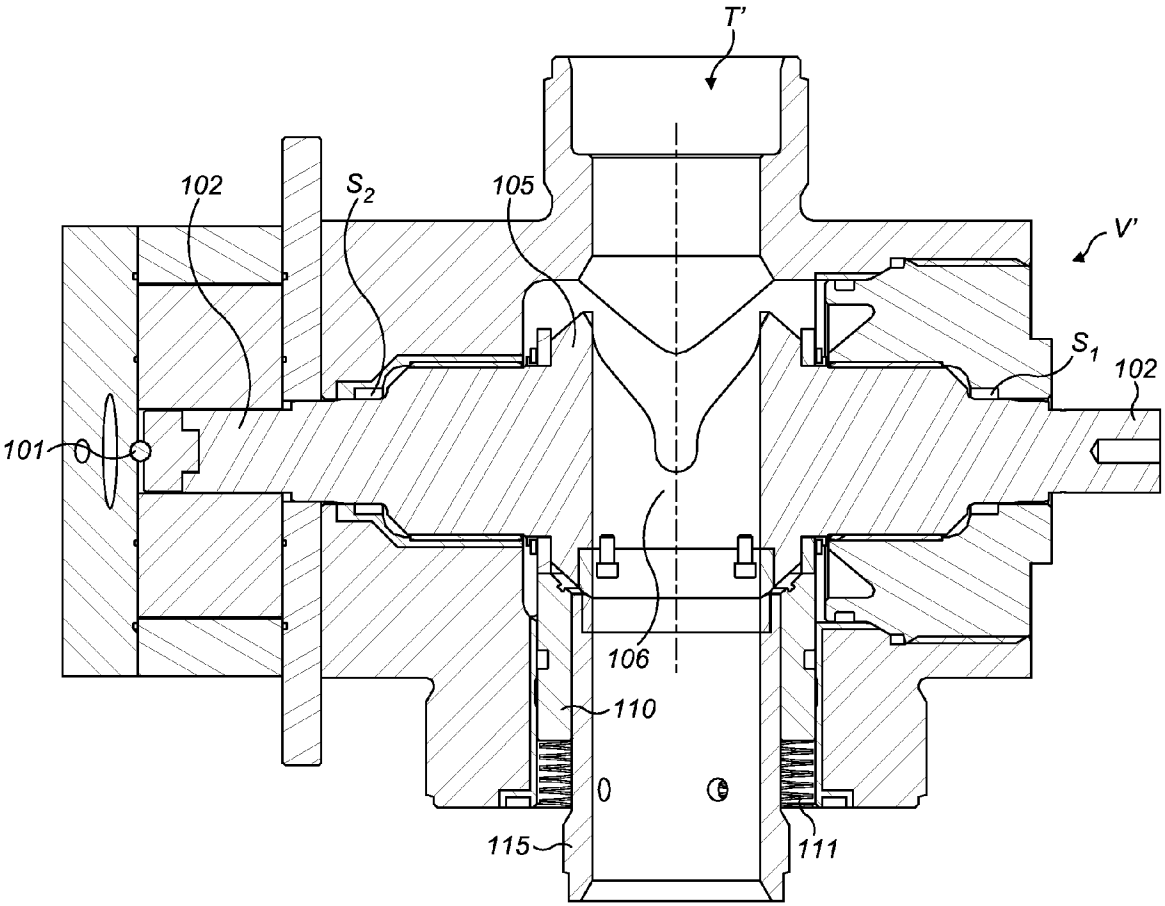
FIG. 16 is a plan view of a second valve according to the invention.

In certain valves the movable member e.g. the ball can be asymmetrically arranged on opposite sides of the axis through the valve. In certain embodiments the tolerance of the ball is different on one side, as compared with the other side of the axis. Typically the ball has a differential sealed area on different sides of the axis, which under pressure causes the ball to move from one side to the other, under the force of the pressure differential. Typically also, the ball has a stop member provided on one side of the axis, typically on the side of the axis to which the ball is urged by the asymmetric differential. Typically the stop member engages the ball with a very precise tolerance, which is more precise than the tolerance between the ball and other parts of the valve, for example between the ball and the socket housing the ball. This asymmetric arrangement between the two sides of the movable member typically means that during assembly, the ball can be held in the socket with the stop member engaging the ball in a position in the socket that is defined by the precise tolerance between the ball and the stop member, rather than by the less precise tolerance between the ball and the socket for example. Also, the asymmetric arrangement which typically causes the ball to move toward the stop member and engage it in that precise location in the socket enables higher confidence location of the ball in the socket during stroking of the moveable member under load, because under load, the ball moves preferentially to engage the stop member, with which it has a very precise tolerance. Therefore, under load, when the ball is engaged with the precise tolerance stop member, the ball is less prone to uncontrolled oscillations or imperceptible "rattling" of the ball in the socket due to machining tolerances between the two, so the location of the ball during stroking is more consistent and more predictable, as the ball is preferentially moved in the direction favoured by the asymmetry between the two sides, and is held in a precise location by the precise tolerance between the stop member and the ball. Generally the machining tolerances between the ball and the socket are very tight, as it is typically important that the contact point between the cutting surface and the anvil member remains as close to possible to pure shear, and free of bending and smearing effects. This is only achievable by ensuring tight fit, good concentricity etc. between the cutting surface on the ball and the shearing surface on the anvil member. It has been found that introducing the asymmetry in the ball increases the predictability of the relative positions of the ball and the anvil, especially under fluid pressure in an axial direction tending to urge the ball in a particular axial direction. The difference need not be noticeable to the naked eye, and a very small asymmetric difference can be sufficient in certain embodiments to introduce the required bias, and improve the predictability of the movement of the ball under pressure. FIG. 16 shows one such example. Referring to FIG. 16, a modified valve V' is generally similar to the valve V and similar features will be indicated in FIG. 18 with the same reference numbers, but increased by 100. The valve V' has at least one ball 105 which is rotatable in a through bore T', on axles 102 which are sealed at S1 and S2, in order to rotate a through bore 106 in the ball 105 in and out of register with the through bore T', to open and close the valve V' in the same manner as previously described for the earlier valve V. The valve V' has a sealing sleeve 110, urged by springs 111, and an anvil sleeve 115, all of which function essentially as described for the previous valve V. The difference between the FIG. 18 valve V' and the valve V disclosed in the previous figures is that in the valve V', the ball 105 is asymmetrically arranged within the through bore T'. In particular, the OD of the axles 105 is typically asymmetric in the valve V', creating a differential sealed area between o-ring or other seals at S1 and S2. In this example, the OD of the axle on the left side of the valve, at S2 is very slightly greater than the corresponding OD on the axle on the right side of the valve at S1. Therefore, the diameter of the sealed area at S2 on the left is larger than the diameter of the sealed area at S1 on the right. Also, on the left side, radially outwardly displaced from S2, the end face of the axle 102 is engaged with a stop member in the form of a bearing 101. The bearing 101 is typically a ball bearing, but other kinds of bearing can be used, e.g. a thrust bearing etc. The tolerance between the bearing 101 and the end face of the axle 102 has a very precise tolerance, so that when the end face of the axle 102 is engaged with the bearing 101, the displacement of the ball 105 in relation to the central axis of the throughbore T' is very precisely known, as a result of the precise tolerance between the bearing 101 and the end face of the axle 102. Because the orientation of the ball 105 relative to the axis of the through bore T' is dependent on the precise tolerance of the stop member 101 and axle 102, the tolerance of the overall system is significantly improved without necessarily improving the tolerance of the other features of the ball 105 within the socket, which can typically be engineered to less precise tolerances, without compromising the performance of the valve V'. When the ball 105 rotates as previously described, the differential sealed areas between S1 and S2 moves the ball 105 preferentially moves toward the left seal S2 in tighter engagement with the stop member 101. Since the stop member 101 and the end face of the axle 102 have the precise tolerance referred to previously, there is significantly more certainty as to the location of the ball 105 under load. The precise tolerance of the stop member 101 and the end face of the axle 102 can be manipulated relatively easily, and the rest of the socket for housing the ball in the body of the valve V' can be made up to a less precise tolerance, without compromising the overall function of the valve. In the present embodiment, the stop member is provided by the bearing 101, which is typically a ball bearing, but other spacers can be used, and other asymmetric characteristics can be adopted (with or without spacers) in alternative examples of the invention.

Modifications and improvements can be incorporated without departing from the scope of the invention. For example, the sealing member can be moved by devices other than cam devices, for example a hydraulic cylinder.

The invention claimed is:

1. An oil or gas well valve, the valve having a through bore with an axis and comprising a movable member configured to move between open and closed configurations of the valve to allow flow of fluid through the through bore of the valve when the valve is in the open configuration, and to resist flow of fluid through the through bore of the valve when the valve is in the closed configuration, the valve having a sealing member in the form of a sealing sleeve providing a seat for seating of the movable member when the movable member is in the closed configuration; the valve having an anvil member axially fixed within the through bore; the movable member having a cutting surface arranged to shear against a cutting surface of the axially fixed anvil member when the movable member is moving between the open and closed configurations; wherein the sealing sleeve is axially movable within the through bore relative to the movable member and the axially fixed anvil member and the axially movable sealing sleeve are arranged with the axially fixed anvil member disposed radially inside the axially movable sealing sleeve, and the axially movable sealing sleeve surrounding the axially fixed anvil member; and wherein the valve includes a sealing member displacement mechanism configured to space the axially movable sealing sleeve axially away from the movable member when the movable member is moving between the open configuration and the closed configuration.

2. The valve of claim 1, wherein the sealing member displacement mechanism moves the axially movable sealing sleeve out of contact with the movable member when the cutting surface engages the anvil member and moves the axially movable sealing sleeve back into contact with the movable member when the cutting surface has passed the axially movable sealing sleeve.

3. The valve of claim 1, wherein the axially movable sealing sleeve remains axially spaced from the movable member until the cutting surface of the movable member has moved past the seat of the axially movable sealing sleeve, after which point the axially movable sealing sleeve is pressed against the movable member to engage the movable member on the seat of the axially movable sealing sleeve.

4. The valve of claim 1, wherein the valve is a ball valve having a ball with a bore through the ball and the movement of the valve between the open and closed configurations is a rotational movement to rotate the bore through the ball between an aligned and an unaligned configuration with respect to the axis of the through bore of the valve.

5. The valve of claim 1, wherein the sealing member displacement mechanism comprises a cam device having a cam surface with a non-circular profile, and wherein the movement of the movable member from the open configuration to the closed configuration moves the non-circular cam surface with respect to the axially movable sealing sleeve so that the axially movable sealing sleeve moves along the non-circular cam surface, whereby the mechanism increases the displacement between the axially movable sealing sleeve and the movable member as the axially movable sealing sleeve moves along the non-circular cam surface.

6. The valve of claim 5, wherein the cutting surface on the movable member has an arcuate structure, and wherein the cam device is configured to displace the axially movable sealing sleeve to a maximum separation from the movable member at the point on the stroke of the movable member when the cutting surface is passing the anvil member.

7. The valve of claim 5, wherein the cam device is located on a rotating part of the valve which rotates with the movable member.

8. The valve of claim 5, having more than one cam device.

9. The valve of claim 5, wherein the cam surface comprises a non-circular projection extending from the outer surface of the movable member.

10. The valve of claim 5, wherein the valve is a ball valve having a ball, and wherein the cam device comprises a pair of non-circular cam surfaces, which are provided on the ball in a parallel and symmetrical arrangement, and whereby rotation of the ball in relation to the axially movable sealing sleeve moves each of the cam surfaces against the axially movable sealing sleeve at the same time.

11. The valve of claim 5, wherein the valve is a ball valve having a ball, and wherein the cam device forms a portion of the outer surface of the ball and spaced radially between the centre of the ball and a tangent on the ball.

12. The valve of claim 5, wherein the cam device is arranged on the movable member out of alignment with the anvil member whereby the movement of the cam device to engage the cam device with the axially movable sealing sleeve does not engage the cam device with the anvil member.

13. The valve of claim 5, wherein the non-circular cam surface of the cam device comprises an outer bearing surface that slides against the axially movable sealing sleeve, to push the axially movable sealing sleeve axially away from the movable member during the stroke of the movable member between the open and closed configurations.

14. A valve as claimed in claim 13, wherein the outer bearing surface of the cam device is arranged on the movable member out of alignment with the seat on the axially movable sealing sleeve, whereby the cam device does not engage the seat of the axially movable sealing sleeve during the stroke of the movable member between the open and closed configurations.

15. The valve of claim 5, wherein the anvil member and the axially movable sealing sleeve are concentrically arranged, with the anvil member located radially inwards of the axially movable sealing sleeve, and the axially movable sealing sleeve surrounding the anvil member.

16. The valve of claim 5, wherein the sealing member displacement mechanism includes a resilient device, and wherein the axially movable sealing sleeve is biased axially against the movable member by the resilient device, and wherein the movement of the movable member energises the resilient device.

17. The valve of claim 16, wherein the movable member has a sealing face, and wherein the resilient devices biases the seat of the axially movable sealing sleeve against the sealing face of the movable member to seal against the passage of the fluid through the valve.

18. The valve of claim 1, wherein the anvil member and the cutting surface have shearing faces which are faced with hardened materials.

19. The valve of claim 1, wherein the sealing member displacement mechanism keeps the axially movable sealing sleeve out of contact with the movable member when the cutting surface is moving past the axially movable sealing sleeve, and moves the axially movable sealing sleeve back into contact with the movable member when the cutting surface has moved past the axially movable sealing sleeve.

20. The valve of claim 1, wherein the axially movable sealing sleeve has a sealing surface configured to match a sealing face on the movable member, and wherein the sealing surface has a resilient seal configured to be compressed against the sealing face of the movable member to create a seal denying fluid passage between the sealing surface of the axially movable sealing sleeve and the movable member.

21. An oil or gas well valve, the valve comprising a movable member comprising a rotatable ball having a through bore with a rim and an axis, and a sealing face, the ball being configured to rotate when the valve is moving between open and closed configurations to allow flow of fluid through the valve when the valve is in the open configuration, and to resist flow of fluid through the valve when the valve is in the closed configuration, the valve having a sealing member in the form of an axially movable sealing sleeve providing a seat for seating of the ball when the ball is in the closed configuration; the ball having a cutting surface provided at the rim of the through bore, which is arranged to shear against an anvil member when the ball is rotating between the open and closed configurations; wherein the anvil member and the axially movable sealing sleeve are concentrically arranged, with the anvil member located radially inwards of the axially movable sealing sleeve, and the axially movable sealing sleeve surrounding the anvil member; wherein the valve includes a sealing member displacement mechanism configured to move the axially movable sealing sleeve axially away from the ball during the stroke of the ball from the open configuration to the closed configuration, wherein the sealing member displacement mechanism comprises a cam device having a cam surface with a non-circular profile provided on the outer surface of the ball, and wherein the movement of the ball from the open configuration to the closed configuration moves the non-circular cam surface with respect to the axially movable sealing sleeve so that the axially movable sealing sleeve moves along the non-circular cam surface, whereby the sealing member displacement mechanism varies the displacement between the axially movable sealing sleeve and the movable member as the axially movable sealing sleeve moves along the non-circular cam surface during the stroke of the movable member between the open configuration and the closed configuration, and wherein the valve includes a resilient device that urges the axially movable sealing sleeve axially against the ball to seal against the passage of fluid through the valve and wherein the rotation of the ball during the stroke of the ball between the open and closed configurations energises the resilient device.

22. The valve of claim 21, wherein forms a portion of the outer surface of the ball and spaced radially between the centre of the ball and a tangent on the ball.

23. The valve of claim 21, wherein the sealing member displacement mechanism keeps the axially movable sealing sleeve away from the cutting surface of the movable member during the stroke of the movable member between the open and closed configurations, so that the axially movable sealing sleeve remains axially spaced from the movable member until the cutting surface of the movable member has moved past the seat of the axially movable sealing sleeve, after which point the sealing member displacement mechanism moves the axially movable sealing sleeve against the movable member to seat the axially movable sealing sleeve on the movable member.

24. A method of operating an oil or gas well valve, the valve having a through bore with an axis and comprising a movable member comprising a rotatable ball having a through bore with a rim, an axis and a sealing face, the ball being configured to rotate when the valve is moving between open and closed configurations to allow flow of fluid through the valve when the valve is in the open configuration, and to resist flow of fluid through the through bore of the valve when the valve is in the closed configuration, the valve having a sealing member in the form of a sealing sleeve providing a seat for seating of the ball when the ball is in the closed configuration; the valve having an anvil member axially fixed within the through bore; the ball having a cutting surface provided at the rim of the through bore, which is arranged to shear against a cutting surface of the axially fixed anvil member when the ball is rotating between the open and closed configurations; wherein the sealing sleeve is axially movable within the through bore relative to the movable member and the axially fixed anvil member and the axially movable sealing sleeve are arranged with the axially fixed anvil member disposed radially inside the axially movable sealing sleeve, and the axially movable sealing sleeve surrounding the axially fixed anvil member; wherein the valve has a sealing member displacement mechanism configured to vary the spacing between the axially movable sealing sleeve and the ball; and wherein the method includes operating the sealing member displacement mechanism to move the axially movable sealing sleeve axially away from the movable member within the through bore during the stroke of the movable member between the open configuration and the closed configuration, the sealing displacement mechanism comprising a cam device having a cam surface with a non-circular profile.

25. The method of claim 24, wherein the sealing member displacement mechanism is provided on the outer surface of the movable member, and wherein the movement of the movable member from the open configuration to the closed configuration moves the non-circular cam surface with respect to the axially movable sealing sleeve; and wherein the method includes moving the non-circular cam surface relative to the sealing member so that the axially movable sealing sleeve translates along the non-circular cam surface, thereby varying the displacement between the axially movable sealing sleeve and the movable member as the axially movable sealing sleeve moves along the non-circular cam surface during the stroke of the movable member between the open configuration and the closed configuration.

26. The method of claim 25, wherein the valve includes a resilient device that is arranged to urge the axially movable sealing sleeve axially against the ball to seal against the passage of fluid through the valve and wherein the method includes energising the resilient device by rotation of the ball during the stroke of the ball between the open and closed configurations.

* * * * *